US005144787A

United States Patent [19]

Whitby et al.

[11] Patent Number: 5,144,787

[45] Date of Patent: Sep. 8, 1992

[54] PACKAGE WRAPPING METHOD AND MACHINE

[75] Inventors: Michael A. Whitby, West Milton; Philip A. Ratermann, Troy; Kinred Bowling, Dayton, all of Ohio

[73] Assignee: Premark FEG Corporation, Wilmington, Del.

[21] Appl. No.: 641,020

[22] Filed: Jan. 14, 1991

[51] Int. Cl.[5] ..... B65B 11/18; B65B 57/12

[52] U.S. Cl. ..... 53/66; 53/556; 53/222; 53/389.3

[58] Field of Search ..... 53/441, 464, 466, 556, 53/66, 389.3, 222, 228

[56] References Cited

U.S. PATENT DOCUMENTS

| | | | |
|---|---|---|---|
| 4,137,691 | 2/1979 | Takahashi | 53/556 X |
| 4,510,731 | 4/1985 | Mathieu | 53/556 X |
| 5,014,489 | 5/1991 | Terminella | 53/556 X |

*Primary Examiner*—John Sipos
*Attorney, Agent, or Firm*—Russell L. McIlwain

[57] ABSTRACT

An elevator-type package wrapping machine which determines as by premeasurement the length of packages fed at a first level thereto, comprises a film gripper for initially drawing a fixed length of stretch film horizontally from a supply roll to a fixed stop position in the machine. While the film is held by the film gripper, a package which has one edge thereof at a predetermined distance from the fixed stop position is elevated to a second level above the level of the gripper into the film such that the package draws a first addition to the length of film drawn by the gripper, according to the height of the package. A vertically-moving horizontal bar is moved into contact with the film remote from the fixed stop position to pull a second additional length of film from the film source in accordance with the measured package length, if required. A film cutter is provided for severing the film from its source while the film is stationary, following which, film side and rear underfolders fold the lateral edges of the film and the rear edge of the film extending from the film source under the package. The underfolders and horizontal bar are operated independent mechanisms, enabling separate timing of each. The package is then pushed essentially horizontally in an outfeed direction, at which time the gripper releases the film and allows the released portion to be underfolded beneath the package as it is pushed. The package is then passed over a heated belt to seal the overlapping edges of the film beneath the package.

3 Claims, 6 Drawing Sheets

PACKAGE WRAPPING METHOD AND MACHINE

This invention relates generally to packaging machines for wrapping stretch film around product supported upon polystyrene foam clear plastic trays, and more particularly, to a package wrapping method and machine wherein a fixed length of transparent wrapping film is initially drawn from a roll supply, and the height and length of the package automatically increase the film length to assure creation of a sheet of film of the proper length to allow for complete underfolding and sealing of the package bottom. Proper film width is determined in conventional fashion by selecting from which one of several rolls the film is drawn, according to measured package width.

BACKGROUND OF THE INVENTION

A variety of machines are available for wrapping film around trayed products, for example meats and produce in supermarkets, to prepare attractive packages for consumer display. An early example of such a machine is illustrated in U.S. Pat. No. 3,662,513 which discloses using a single length and width of stretchable film for a narrow range of package sizes and heights. The machine would have to be shut down for making several manual adjustments if another range of package sizes was to be wrapped. When wrapping packages in this design, in order to properly wrap the largest or highest package within the range, excess and therefore wasted film results for the smaller sizes. Excess film creates unsightly clumps of film on the bottom of such smaller packages, and this in turn results in poor bottom seals and leaking packages.

To overcome the problems created by using a single fixed length stretchable film sheet for wrapping several package sizes, film wrapping machines have been developed which permit the automatic selection of a variety of film lengths to accommodate varying package sizes. An example of an automatic film length selection mechanism for a film wrapping machine is disclosed in U.S. Pat. No. 4,510,731. In this patent, the automatically measured length of a package controls the stroke distance of a reciprocable film gripper to draw the appropriate length of film from the supply roll for wrapping the particular package. However, the stroke adjusting mechanism is complicated, requiring special mechanical linkage, an adjusting control motor, sensing switches and control electronics to automatically vary the lengths of film drawn into the machine. Accordingly, while the adjustable mechanism was a substantial improvement over the fixed film length wrapping of then-existing prior art, it entailed greater initial cost and maintenance expense.

Another film sheet sizing arrangement is disclosed in French Patent Publication No. 2,410,601 wherein a film sheet is held across the path of an obliquely raised elevator. In the French publication, a package is placed on the elevator and obliquely raised into and through a plane defined by the film to thereby draw any additional film which is required by the height of the package from a continuous source of the film. The obliquely raised elevator comprises a surface which is sequentially replaced by a film underfolder to thereby support the package and permit the elevator to be lowered for the next package to be wrapped. Film length is derermined by severing the sheet only after the underfolder has been entirely inserted under the package to position the severed film end at a film holding mechanism for the next package. The leading and trailing edges of the film are brought together to form an overlapping sleeve arrangement for wrapping the package.

Another film sheet sizing arrangement is disclosed in U.S. Pat. No. 4,813,211, issued Mar. 21, 1989, entitled "Package Wrapping Method and Machine," by Fritz F. Treiber and assigned to the same assignee as the present application. According to this patent, the length of each package is measured during its travel to a wrap station. A fixed length of film is initially drawn by a film gripper into the wrapping machine to the same stop or end position for all package sizes. A package is placed on an elevator and is raised into and through a plane defined by the film, thereby permitting the package height to draw a first film addition from the source if the height is above a certain minimum. A rear underfolder bar is moved horizontally into contact with the film at a location between the package and the film source to commence film underfolding beneath the package. As this takes place, a heated cut-off wire is passed through the film vertically, behind the bar. The timing of the wire passage is such as to provide the proper film length in accordance with the initial measured length of the package. The net result is to provide an initial fixed film length for all package sizes, a first inherent additional film draw for high packages and a second measured film length by timing an on-the-fly sheet cut to occur after the package is fully elevated and has pulled all the extra film needed. The first additional film draw is made somewhat similarly to that of the aforementioned '601 French Publication. However, a problem encountered in the '211 patent system occurs when using heavy gauge film of 0.001 inches or greater or using foam trays with weak edges. Under such circumstances the film tension force applied to the foam trays at their trailing edges caused trays to break or crack on occasion during underfolding. That requires a rewrap and results in lost production time. In addition, because the rear underfolder of the '211 patent is also used to advance the tail of the film for obtaining the second measured length, it was necessary to use a cut-off or severing means capable of effectively cutting "on-the-fly" and passing through the moving film rapidly while it is under tension. Not only is a mechanical knife felt unsuitable for cutting moving film, but an on-the-fly cut requires immediate braking of the film and roll behind the cut, in order to properly present the cut end to film grippers for the next sheet of film to be pulled.

Accordingly, it is apparent that the need exists for an improved package wrapping method and machine which eliminates the complicated prior art sheeting arrangements, is more compact in size, will not damage the package trays or tear the film, yet still provide film lengths selected in response to measurement of package dimensions to conserve film and provide attractive film wrapping characteristics.

SUMMARY OF THE INVENTION

In accordance with one aspect of the present invention, a method for wrapping packages in stretch film comprises operating an infeed conveyor to carry a package of designated length to an elevator of a wrapping station and to locate the package at a registration position on one side of the elevator. The designated length is preferably determined by an automatic package length measurement, but can be manually inputted by the operator into the controls by conventional knobs or buttons. The registration position is preferably toward the operator, but may feasibly be toward either side of the machine. A free end of a continuous source of stretch film is gripped on the side of the elevator opposite to the side including the registration position and is drawn over the elevator to a defined position beyond the registration position. In the preferred form or machine, side clamps are operated to engage the lateral edges of the film over the elevator and are moved outwardly to prestretch the film laterally. The package is then elevated into the film to further stretch the film. If the package exceeds a certain minimum height, movement of the package into the film draws an additional length of film from the supply roll. A vertically-moving horizontal bar is moved into contact with and forms a loop in the film to pull a second length of additional film from the film source in accordance with the pre-measured length of the package. The preferred form of bar is a freely rotatable rod to provide for rolling contact with the film to prevent or minimize drag. The rear edge of the film is then severed behind the loop from the continuous source of film while the film is stationary or essentially so, to produce a sheet of film of suitable length for the length of the package being wrapped. Rear and side underfolders are then operated independently of the mechanism for operating the bar, to fold the lateral and trailing edges of the film under the package. The side clamps are opened substantially upon engagement of the film by the side underfolders. The package is finally ejected by pushing it from the wrapping station to fold the originally gripped free end of film under the package. The originally gripped end is released as the package is ejected from the wrapping station.

A primary object of the invention is to provide, in the type of package wrapping machine and method wherein a fixed length of film is initially pulled from a supply roll to a predetermined stop position and film is then further advanced from the roll in accordance with a designated or pre-measured package length, an improved apparatus and technique which enables a cut-off action to take place while the film is stationary or essentially, so that a mechanical cutting device can be used.

Another object is to provide such an apparatus and technique wherein the means for performing the film cut-off action operates independently from any film underfolding mechanism, thereby allowing film advancement to be timed and adjusted separately from film underfolding.

Ancillary to the last-mentioned object is the capability of performing film cutting while the film is stationary.

Other objects and advantages of the invention will be apparent from the following description, the accompanying drawings and the appended claims.

DETAILED DESCRIPTION OF THE INVENTION

Figure 1:
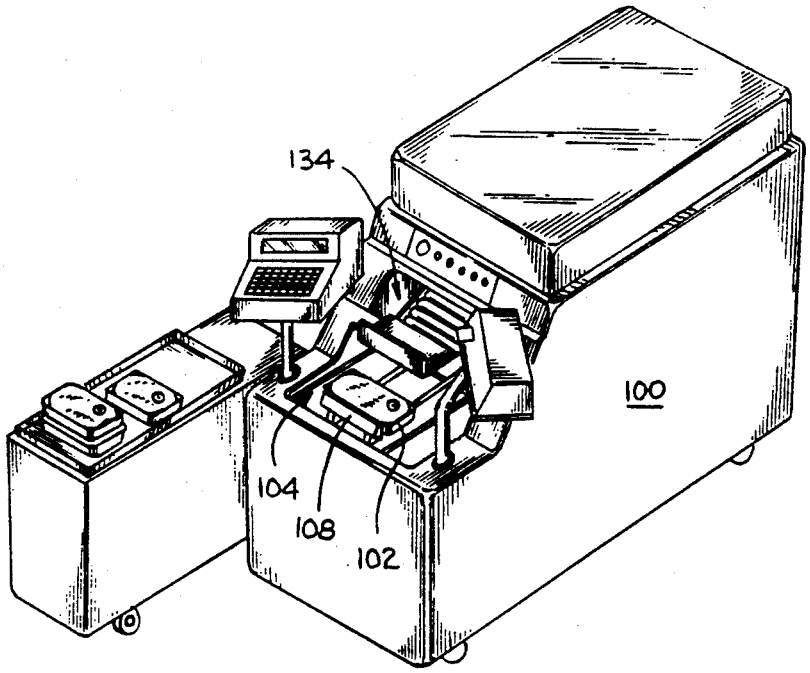
FIG. 1 is a perspective view of a package wrapping and weighing machine embodying the invention of the present application.
Figure 2:
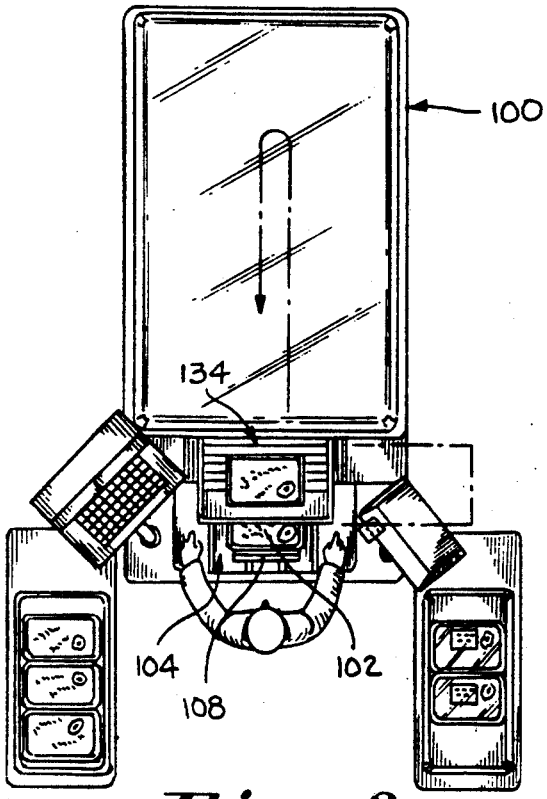
FIG. 2 is a plan view of the package wrapping and weighing machine of FIG. 1 showing the convenient operation and ergonomics for an operator of the machine.

The general operation of a package wrapping and weighing machine 100 incorporating the present invention will be described with reference to FIGS. 1–5. A package 102 comprising, for example, meat, produce or other food products placed upon a tray is to be wrapped in stretchable heat-sealable film, then weighed and labeled for attractive display. The package 102 is placed in a package infeed station 104 from which it is conveyed to a package wrapping station 106 by an intermittently-operated first infeed conveyor means which comprises package pushers 108.

Figure 3:
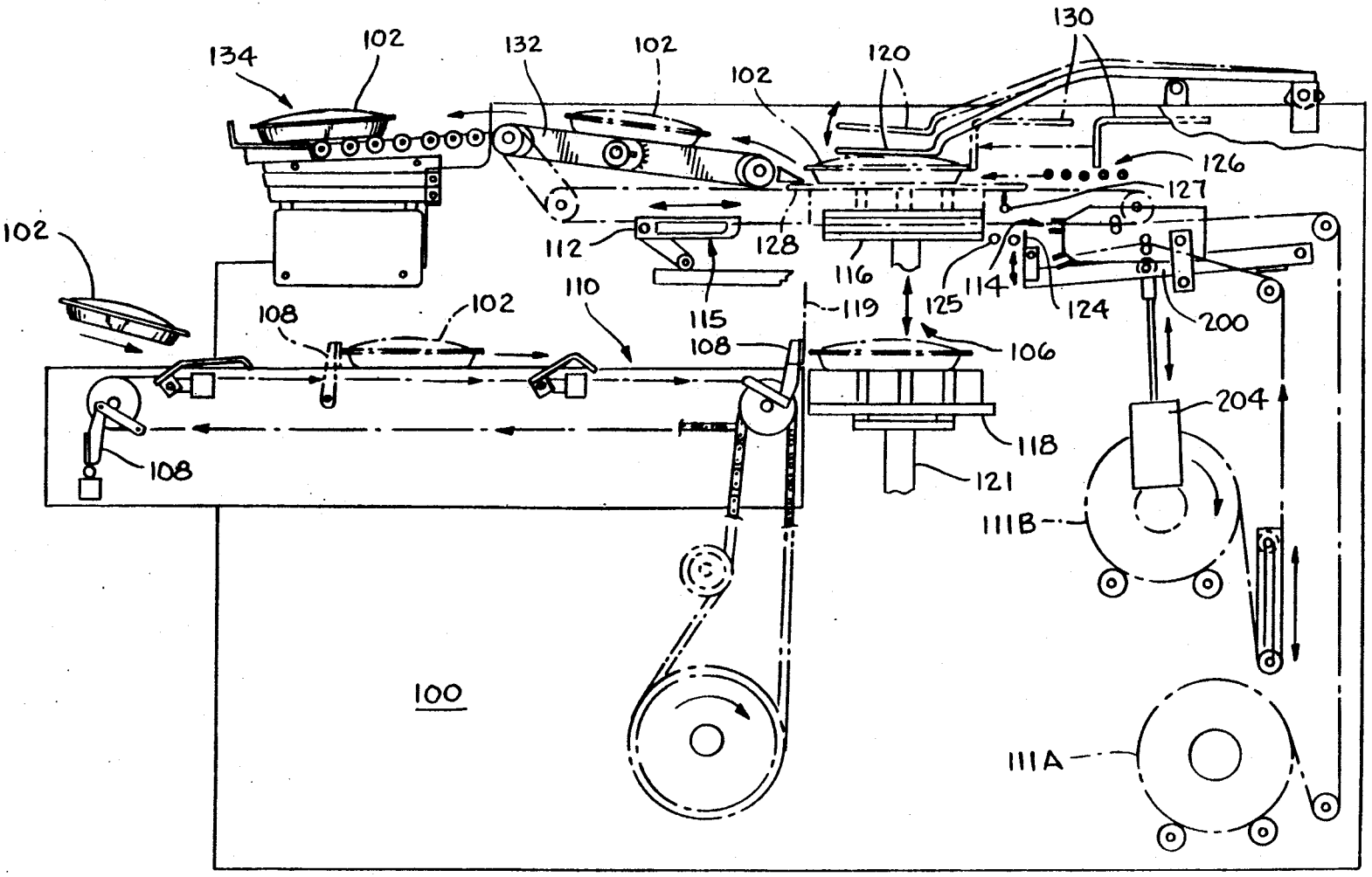
FIG. 3 is a diagrammatic vertical cross-section taken generally along the longitudinal center line of the package wrapping and weighing machine of FIG. 1.
Figure 4:
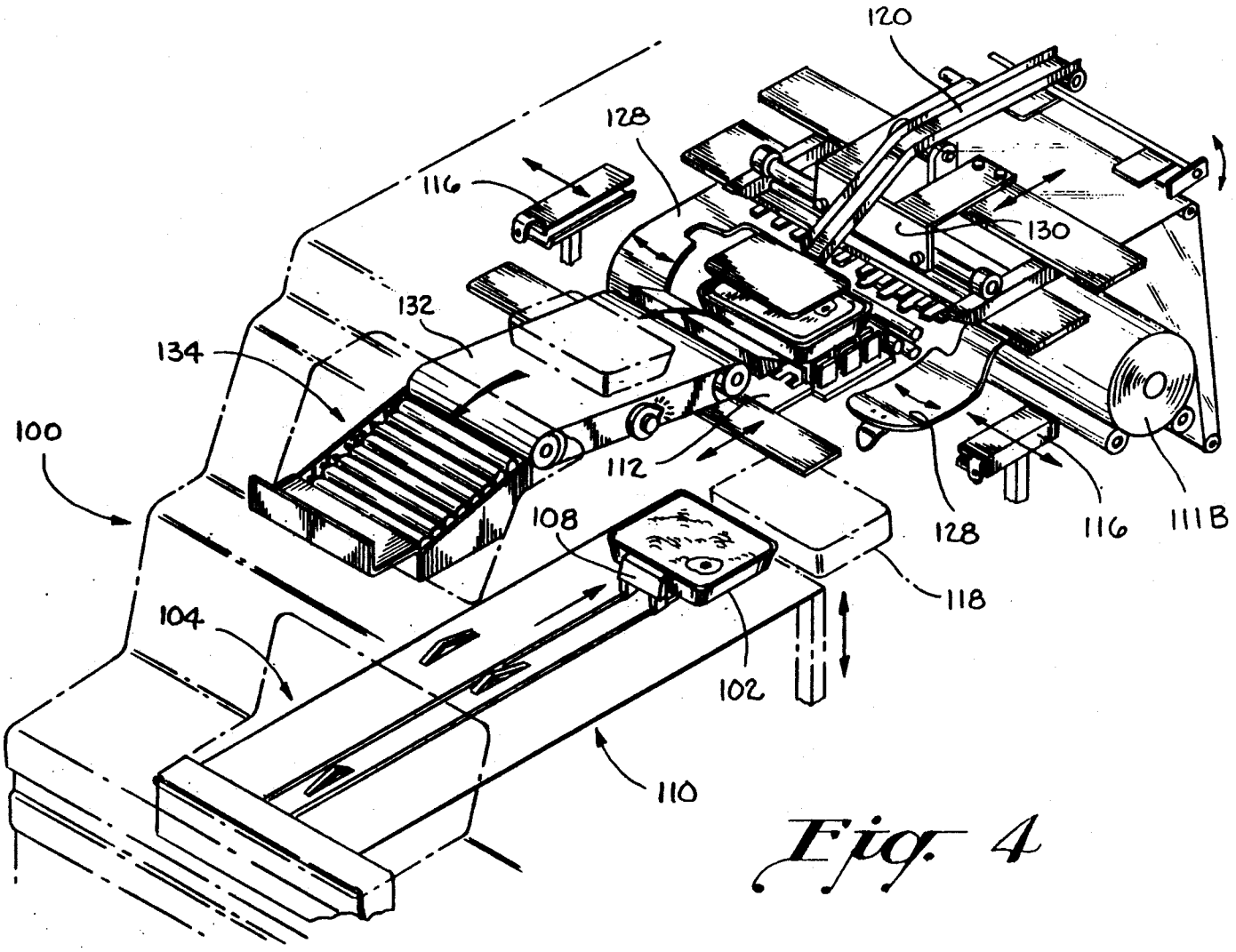
FIG. 4 is a perspective schematic view of key elements of the wrapping and weighing machine of FIG. 1.

The package 102 is carried along a package entryway 110 which includes the package infeed station 104 and extends to the package wrapping station 106. As the package 102 is conveyed along the package entryway 110 by one of the package pushers 108, a horizontally-extending film gripper or gripper bar 112 was moved to a fixed film end engaging position 114 where the free end of a continuous source or roll 111A or 111B can be grasped. The film is gripped by the gripper bar 112 and drawn into the machine 100 by retraction of the gripper bar 112 to the left as shown in FIG. 3 to a fixed film draw or defined stop position 115. Accordingly, the film initially drawn by the film gripper 112 is of a fixed length for all sizes of packages. Much of what is about to be described is similar to that shown in the aforementioned U.S. Pat. No. 4,813,211, which is incorporated herein by reference.

As the package 102 enters the machine 100, the width and length of the package 102 are measured. Width and length may be measured as disclosed in the above U.S. Pat. No. 4,813,211. Length is determined by engagement of a package 102 with an upwardly biased sensing member 182 which actuates a switch 184. The timing of actuation of switch 184 in relation to the machine timing indicates a certain distance exists ahead of the pusher 108 upon actuation of the switch. The width measurement by conventional laterally-spaced switches (not shown) determines which of the pair of different-width film rolls 111A or 111B has its free end presented to be received by the gripper bar 112. It should be noted that, in the illustrated embodiment of the package wrapping and weighing machine 100, the width of a package refers to the package dimension across the machine and the length refers to the package dimension lengthwise of the machine. The length measurement is used to control the amount of advancement of the trailing edge of the film prior to its being cut at a cut line by a serrated knife 124, in order to have the length of film coincide with the requirements to fully cover the bottom of a given package in the lengthwise direction without having excess film.

The film initially drawn into the machine 100 is held in tension by the film gripper 112 and is taken by side clamps 116 which engage opposite sides of the film and stretch it outwardly toward the sides of the machine 100 in known fashion. By this time, the package 102 has been positioned on a package elevator 118 at a first level at a package registration edge 119 defined by a stopped package pusher 108, as shown in FIG. 3. An elevator support member 121 which is activated by a series of cams and levers vertically moves elevator 118 with the package 102 through the plane of the prestretched film to an upper second level wherein the elevated package is shown in dot-dash lines in contact with a pad of a hold down arm 120.

As noted, film drawn by the gripper 112 is of a fixed length since the film gripper 112 moves from the film end engaging position 114 to the defined stop position 115. Additional film can be drawn from one or the other of two continuous rolls 111A or 111B during the package wrapping process. A first addition to the film drawn by the gripper 112 is drawn as the package is elevated through the plane of the prestretched film since it is being held by the film gripper 112 and the side clamps 116. The first additional amount of film drawn, if any, corresponds to the height of the package. Hence, the machine is arranged so that a low package draws no additional film during elevation, while a high package may draw considerable additional film in known fashion.

Figure 5:
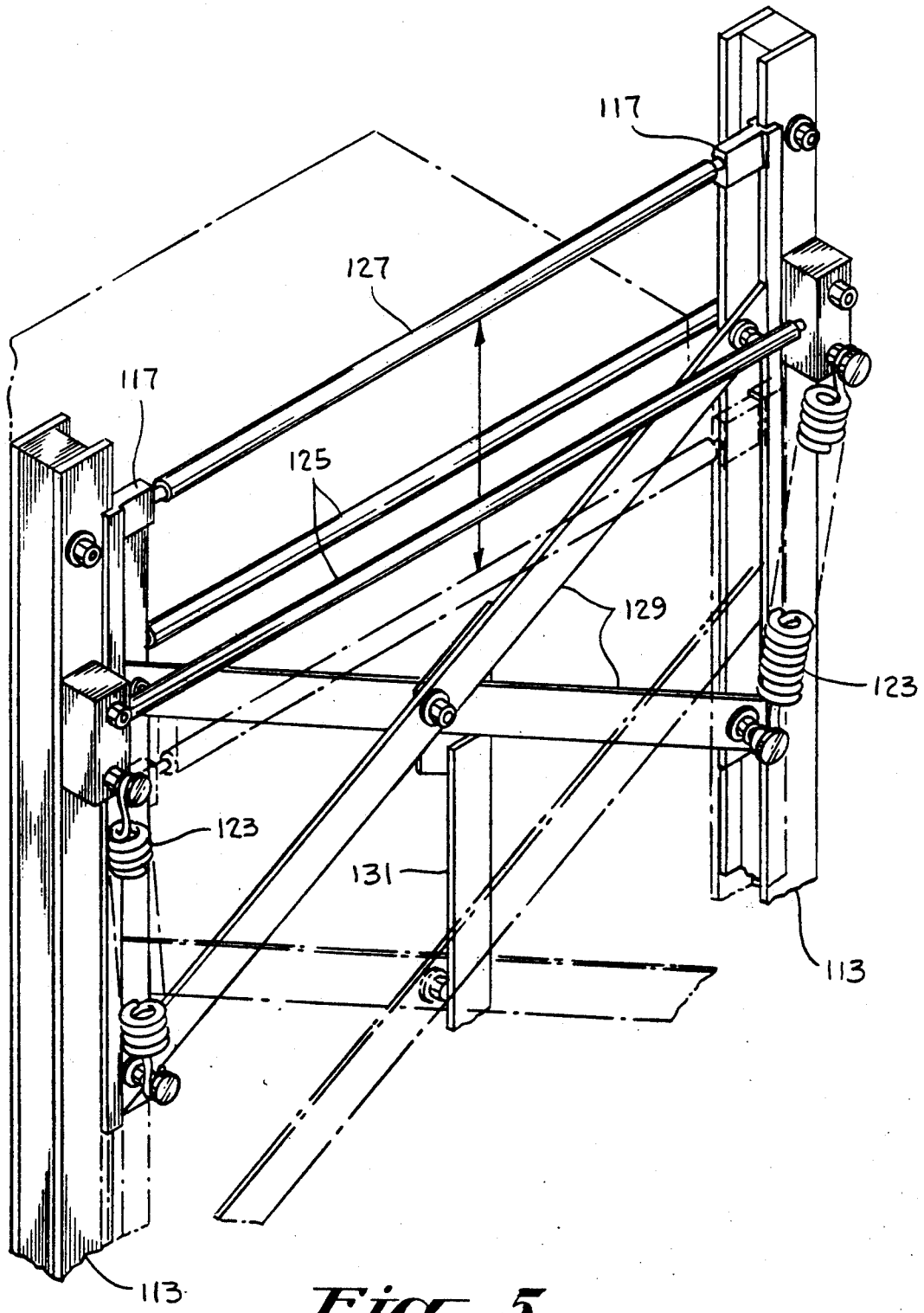
FIG. 5 shows the vertically moving horizontal bar assembly with the bar or rod in its inactive, uppermost position in solid lines and showing the bar in dotted lines in one of its active downward end positions, pulling a loop of film to advance the tail from the film supply.

A second additional amount of film, if any, is incrementally drawn by a vertically moving horizontal bar or rod 127. Broadly speaking, the mechanism for operating bar 127 can be said to be a film tail advancing means. In the illustrated embodiment, the bar may be kept stationary for a short package length, in which case the tail is not advanced at all, or the unit may be selectively operated to move the bar to advance the tail toward the package an additional 1", 4" or 9" to increase the film length. The number and dimensions of the added lengths can be varied with the machine design according to the range of packages to be wrapped. As shown in FIGS. 3 and 5, the film from the supply moves along and over horizontally-spaced fixed position bars 125 and under the vertically moving horizontal bar 127 such that vertical and draw additional film from the supply. In their preferred form, bars 125 and 127 are freely rotatable circular rods to prevent or minimize friction between the bars and film. The film rolls are free-wheeling to allow turning during the advance of film, since the film is held firmly at its lead end by the gripper bar 112 at the defined stop position 115. Accordingly, the greater the downward movement of the bar 127, the greater the amount of additional film will be drawn from the rolls and the more advance of the film tail.

The amount of downward movement of the horizontal bar 127 is preferably controlled by sensing or measuring the length of the package but may be controlled manually by the operator as noted earlier. As the latter is well known in the art, it will not be described herein. As shown in FIG. 5, the horizontal bar 127 is driven downwardly by a pair of cross bars 129 which are mounted to a pair of vertical guide blocks 117. The guide blocks 117 move along stationary vertical guide rails 113. The guide blocks 117 are biased in an upward position by springs 123. The cross bars 129 are driven downwardly by a vertically extending connecting member 131 (see FIGS. 5 and 6) which is controlled by a chain assembly 133.

Figure 6:
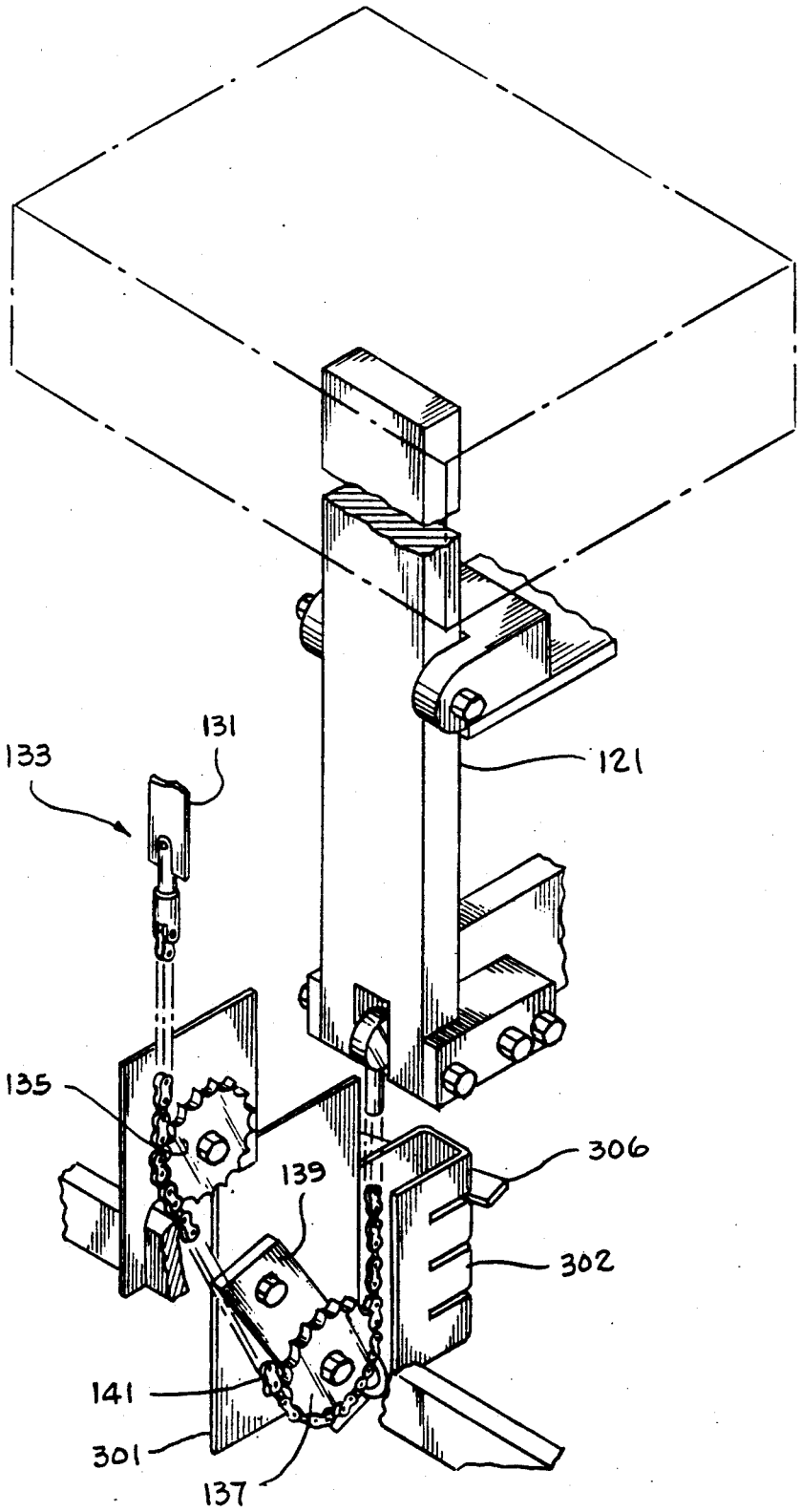
FIG. 6 shows the chain assembly for vertically moving the horizontal bar of FIG. 5.
Figure 7:
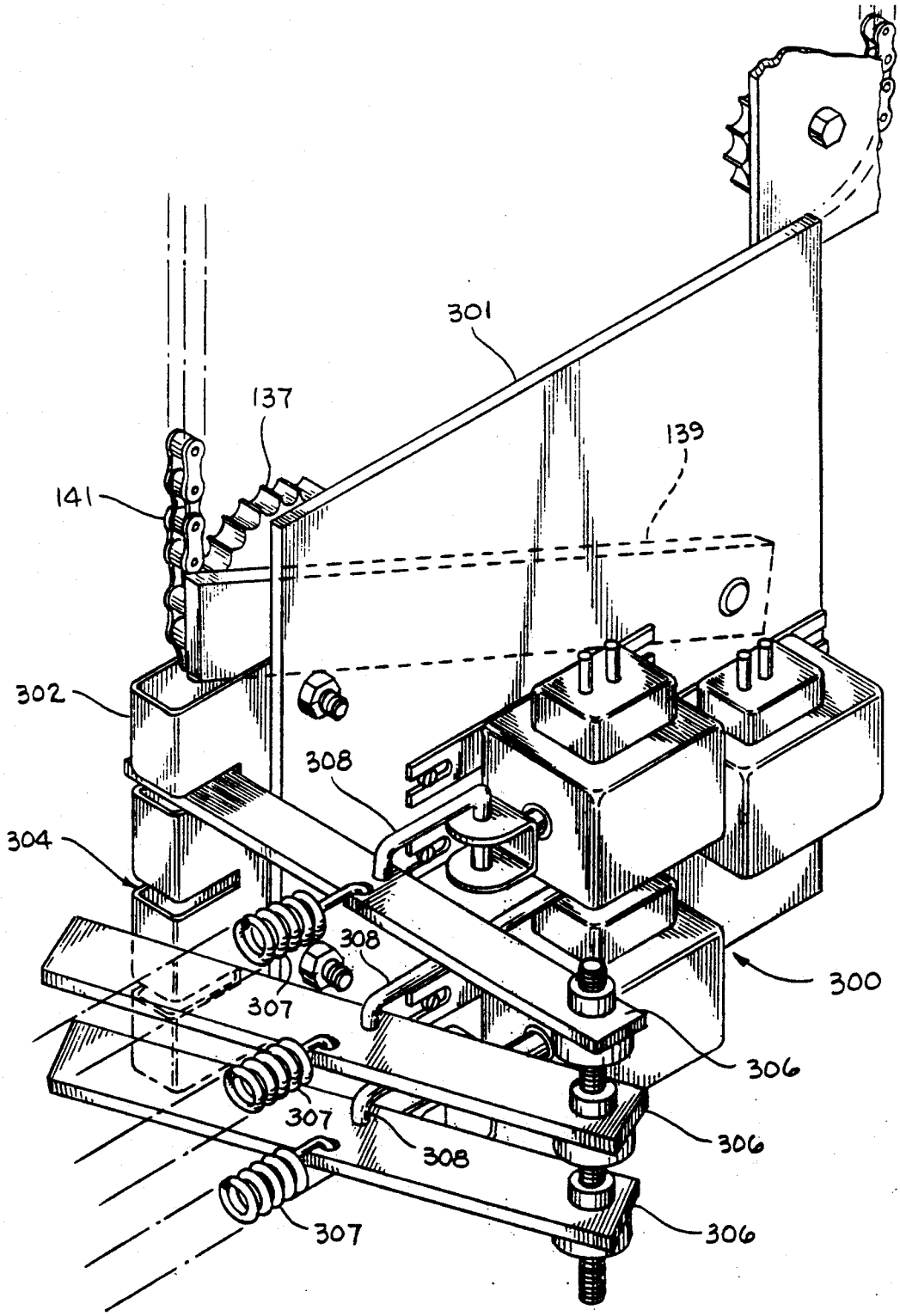
FIG. 7 shows the assembly for controlling the extent of movement of the vertically moving horizontal bar in response to designating package length.

As shown in FIGS. 6 and 7, the chain assembly 133 includes a fixed axis sprocket 135, a floating axis sprocket 137 mounted on a pivoting arm 139, and a drive chain 141 which meshes with the sprockets 135 and 137 and is attached at its end opposite member 131 to the elevator support member 121.

Control of the amount of vertical movement of arm 139 is determined by stopping or arresting the final position of the arm 139 short of the uppermost travel. At the time of arrest, chain 141, where attached to connecting member 131, pulls downwardly on the connecting member a controlled amount, depending upon where the arm 139 was arrested. At the time of arrest, the sprocket 137 becomes fixed in position and the chain rides around the two sprockets 135 and 137 to pull down on member 131, extending springs 123. Obviously, when the elevator moves downwardly, tension of springs 123 and gravity acting on arm 139 will return all of the elements to their original conditions. In the mechanism disclosed, the arm is intercepted during its upward travel to fix the final upper position of sprocket 137 for a specific package length. That final upper or arrested position of sprocket 137 translates into the amount that bar 127 is lowered.

The amount of vertical movement and the vertical positioning of the floating sprocket 137 is controlled by a control assembly, generally designated 300 in FIG. 7. In operation, the pulling action of the drive chain 141 resulting from the upward movement of the elevator 118 and the elevator support member 121 produces pivotal movement of arm 139. In case of packages which require no additional film tail advance, the pivoting arm 139 is permitted to fully pivot upwardly, without being intercepted, thereby positioning the floating sprocket 137 at its highest position. The elevator 118 thus moves to its fully elevated position without pulling the chain 141 downwardly. Horizontal bar 127 (FIG. 5) thereby remains in its 0" or no tail advance position, and no additional film is drawn. In case of packages which do require a second additional amount of film, the vertically pivoting arm 139 is constrained from total pivotal movement by the control assembly 300 thereby preventing the floating sprocket 137 from attaining its uppermost vertical position. In this way, upward movement of elevator 118 and elevator support member 121 causes the drive chain 141 to pull downwardly on connecting member 131 which results in the downward movement of the horizontal bar 127, thus drawing additional film.

As shown in FIG. 7, the control assembly 300 comprises a stationary U-shaped channel 302 mounted to a support plate 301 which also carries the pivot for arm 139. Plate 301 is positioned parallel to the plane of movement of the pivoting arm 139. Channel 302 includes a plurality of parallel notches or slots 304. Sprocket 137 floats and is guided vertically within channel 302. A plurality of parallel interceptor bars 306 are pivotally mounted to a fixed frame (not shown) to horizontally pivot into and out of engagement with corresponding slots 304. The bars 306 are moved between their intercepting and non-intercepting positions by a plurality of solenoid activated arms 308. Each arm 308 is attached to its bar 306 for pivoting the bar 306 into and out of engagement with a corresponding slot 304. A spring 307 or the like is provided for biasing the bar 306 outwardly of its slot 304, and energization of a solenoid 303 pulls its bar 306 into its slot 304.

In operation, actuation of switch 184 designates or determines the amount of additional film to be drawn. If no additional amount of film is required, none of the bars 306 is pivoted into its slot 304. Thus, the arm 139 is allowed to pivot freely to its uppermost limit within channel 302 and no additional film will be drawn. If the measured length determines that an additional amount of film is required, the appropriate solenoid-activated arm 308 is retracted by its solenoid 303 thereby moving the appropriate bar 306 into engagement with slot 304. This causes the distal end of the arm 139 to be intercepted by one of the bars 306, restricting further pivotal movement of arm 139.

Since three slots 304 and bars 306 are shown, the illustrated design can pull three different tail lengths of film in addition to the fourth which constitutes zero pull if arm 139 can take its full upward stroke.

As shown in FIG. 3, the film drawn into the machine 100 is ultimately severed at a cut line by cutter means preferably comprising the serrated knife 124. Knife 124 is timed to function at the time the bar 127 has reached its lowermost position and has advanced the tail end of the film to the extent called for by the sensed package length. This is accomplished by actuating solenoid 204 to rapidly urge lever 200 to cause the knife to cut the film. The film is then folded under the package 102 by a rear underfolder 126 and by side underfolders 128 which are activated in synchronism with the rear underfolder 126. The general operation of the rear underfolder 126 and the side underfolders 128 are well known in the art and fully described in aforementioned U.S. Pat. No. 4,510,731.

Sufficient film is required for the film to be underfolded in an overlapping fashion on the bottoms of packages such that the packages can be heat-sealed. In the case of packages which have a short length, the serrated knife 124 severs the film immediately prior to engagement of the film by the rear underfolder 126 since sufficient film has already been drawn into the machine 100 to properly overlap on the bottom of the package. In the case of packages which are greater in length, the vertically moving horizontal bar 127 is moved into contact with the film to pull a length of additional film from the film source. The film will then be severed from the continuous source of film and the rear underfolder 126 will then engage the drawn film and start underfolding the rear of the film. In this way, complete overlapping of the underfolded film on the bottoms of longer packages will be provided. The package 102 with a film section thus drawn and underfolded on three sides :s pushed out of the wrapping station 106 by a package pusher 130, shown in FIG. 3 in dotted lines as it contacts a package to move it leftwardly in an outfeed direction. What was formerly the trailing registered package edge now becomes the leading package edge in relation to its direction of travel.

As the package 102 is pushed from the wrapping station 106 by a package pusher 130, the originally-gripped free end of film is released by the film gripper bar 112 and folded under the package 102 in known fashion by a second conveyor means for carrying the package 102 from the wrapping station 106 to a weighing station 134. In the illustrated embodiment, the second conveyor means comprises a heat-sealing conveyor 132 and the weighing station 134 comprises a scale 136 as shown in U.S. Pat. No. 4,813,211.

What is claimed is:

1. Apparatus for wrapping rectangular packages in stretch film comprising:

means for designating the horizontal length of packages;

film supply means for supplying a continuous web of stretch film in roll form;

releasable gripping means for gripping a free end of said web and pulling it to the defined stop position in a wrapping station;

side clamps adjacent the wrapping station for initially clamping and subsequently releasing the two side edges of film when the film is in said defined stop position;

means for elevating a package into the gripped and clamped film between a first infeed level and a second outfeed level and drawing from said film supply means any additional film required by a package having a height above a predetermined minimum;

package infeed means for conveying packages at said first level in a direction opposite to the film pulling direction to a package trailing edge registration position adjacent but beyond said defined stop position whereby to provide for underfolding a predetermined length of film beneath the edge of each package;

film length adjustment means including a vertically movable horizontal bar movable into contact with said film at a position between said film supply means and said elevating means for pulling from said film supply means a loop of additional film corresponding to the designated length of the package being wrapped;

means for severing said film at a cut line between the loop and said supply to create a film trailing edge and thereby produce a film sheet of suitable length for the length and height of each package;

folding means independently operable of said film length adjustment means for folding the side edges and the film trailing edge under said package in synchronism with the releasing of said side edges by said side clamps; and means for pushing each package essentially horizontally from the wrapping station along said second level in synchronism with releasing of said gripping means to underfold film under the package trailing edge during said pushing;

whereby said elevating means and said film length adjusting means are mechanically interconnected whereby upward motion of said elevating means causes downward movement of said vertically movable horizontal bar.

2. Apparatus according to claim 1 including a control assembly operatively connected to said mechanical interconnection, said control assembly including means responsive to said designating means whereby to alter the effective length of said mechanical interconnection and thereby determine the depth of the stroke of said movable bar in accordance with the designated package length.

3. Apparatus according to claim 2 wherein said mechanical interconnection includes a fixed axis sprocket, a vertically floating axis sprocket and a chain passing around said sprockets and connected at its ends to said elevating means and said vertically movable horizontal bar; and wherein said means for altering the effective length of said mechanical interconnection includes a plurality of means for arresting floating of said floating axis sprocket at predetermined positions at which time the chain pulls downwardly on said bar an amount related to the predetermined position at which said sprocket was arrested.

* * * * *